US008550910B2

(12) United States Patent
Ward

(10) Patent No.: US 8,550,910 B2
(45) **Date of Patent: *Oct. 8, 2013**

(54) GAMING SYSTEM HAVING GRAPHICAL USER INTERFACE FOR CONFIGURATION OF WAGERING GAMES

(71) Applicant: WMS Gaming Inc., Waukegan, IL (US)

(72) Inventor: Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/654,612

(22) Filed: Oct. 18, 2012

(65) Prior Publication Data

US 2013/0040725 A1 Feb. 14, 2013

Related U.S. Application Data

(63) Continuation of application No. 12/740,063, filed as application No. PCT/US2008/012184 on Oct. 28, 2008, now Pat. No. 8,313,382.

(60) Provisional application No. 61/001,474, filed on Nov. 1, 2007.

(51) Int. Cl.
*G07F 17/32* (2006.01)

(52) U.S. Cl.
USPC ..... 463/31; 463/16; 463/20; 463/25; 463/29

(58) Field of Classification Search
USPC ..... 463/16, 20, 25, 29, 31
See application file for complete search history.

(56) References Cited

U.S. PATENT DOCUMENTS

| | | | | |
|---|---|---|---|---|
| 5,042,809 | A | 8/1991 | Richardson | |
| 5,083,271 | A | 1/1992 | Thacher et al. | |
| 5,655,961 | A | 8/1997 | Acres et al. | |
| 5,761,649 | A | 6/1998 | Hill | |
| 5,816,918 | A * | 10/1998 | Kelly et al. | 463/16 |

(Continued)

FOREIGN PATENT DOCUMENTS

| | | |
|---|---|---|
| AU | 5251830 | 12/2005 |
| WO | 2005/120672 A1 | 12/2005 |

(Continued)

OTHER PUBLICATIONS

Written Opinion corresponding to International Patent Application Serial No. PCT/US2008/012184, United States Patent Office; dated Jan. 9. 2009; 6 pages.

(Continued)

*Primary Examiner* — Omkar Deodhar
(74) *Attorney, Agent, or Firm* — Nixon Peabody LLP

(57) ABSTRACT

An operator control interface for configuration of wagering games comprises a control screen for displaying a plurality of available primary wagering games and a plurality of available supplemental features and at least one input device for receiving configuration inputs. At least one controller is operative to (i) in response to a first configuration input received via the at least one input device, add a selected primary wagering game to a first wagering game configuration, (ii) in response to a second configuration input received via the at least one input device, add a selected supplemental feature to the first wagering game configuration, and (iii) cause the control screen to display the first wagering game configuration and an overall payback percentage of the first wagering game configuration.

45 Claims, 8 Drawing Sheets

(56) References Cited

U.S. PATENT DOCUMENTS

| | | | |
|---|---|---|---|
| 5,851,149 | A | 12/1998 | Xidos et al. |
| 5,993,316 | A | 11/1999 | Coyle et al. |
| 6,155,925 | A | 12/2000 | Giobbi et al. |
| RE37,885 | E | 10/2002 | Acres et al. |
| 6,645,077 | B2 | 11/2003 | Rowe |
| 6,884,173 | B2 | 4/2005 | Gauselmann |
| RE38,812 | E | 10/2005 | Acres et al. |
| 7,144,321 | B2 | 12/2006 | Mayeroff |
| 7,285,049 | B1 | 10/2007 | Luciano, Jr. et al. |
| 7,914,377 | B2 | 3/2011 | Benbrahim et al. |
| 2005/0197191 | A1 | 9/2005 | McKinley et al. |
| 2006/0073887 | A1 | 4/2006 | Nguyen et al. |
| 2006/0073888 | A1 | 4/2006 | Nguyen et al. |
| 2006/0084496 | A1 | 4/2006 | Jaffe et al. |
| 2006/0142079 | A1 | 6/2006 | Ikehara et al. |
| 2006/0148549 | A1 | 7/2006 | Walker et al. |
| 2006/0252530 | A1 | 11/2006 | Oberberger et al. |
| 2006/0264256 | A1* | 11/2006 | Gagner et al. ..... 463/20 |
| 2007/0060258 | A1 | 3/2007 | Duhamel |
| 2007/0060314 | A1 | 3/2007 | Baerlocher et al. |
| 2007/0060321 | A1 | 3/2007 | Vasquez et al. |
| 2007/0155490 | A1 | 7/2007 | Phillips et al. |
| 2007/0191088 | A1 | 8/2007 | Breckner et al. |
| 2007/0218975 | A1 | 9/2007 | Iddings et al. |
| 2007/0225065 | A1 | 9/2007 | Wright et al. |
| 2007/0259709 | A1 | 11/2007 | Kelly et al. |
| 2007/0293293 | A1 | 12/2007 | Baerlocher et al. |
| 2007/0298857 | A1 | 12/2007 | Schlottmann et al. |
| 2007/0298874 | A1 | 12/2007 | Baerlocher et al. |
| 2007/0298875 | A1 | 12/2007 | Baerlocher et al. |
| 2008/0020830 | A1 | 1/2008 | Ikehara et al. |
| 2008/0020831 | A1 | 1/2008 | Ikehara et al. |
| 2008/0020832 | A1 | 1/2008 | Iddings et al. |
| 2008/0020833 | A1 | 1/2008 | Baerlocher et al. |
| 2008/0020834 | A1 | 1/2008 | Breckner et al. |
| 2008/0020846 | A1 | 1/2008 | Vasquez et al. |
| 2008/0045344 | A1 | 2/2008 | Schlottmann et al. |
| 2008/0064502 | A1 | 3/2008 | Schlottmann et al. |
| 2008/0070680 | A1 | 3/2008 | Baerlocher et al. |
| 2008/0070692 | A1 | 3/2008 | Schlottmann et al. |
| 2008/0070693 | A1 | 3/2008 | Schlottmann et al. |
| 2008/0070694 | A1 | 3/2008 | Schlottmann et al. |
| 2008/0070695 | A1 | 3/2008 | Baerlocher et al. |
| 2008/0076514 | A1 | 3/2008 | Baerlocher et al. |
| 2008/0076515 | A1 | 3/2008 | Baerlocher et al. |
| 2008/0076517 | A1 | 3/2008 | Baerlocher et al. |
| 2008/0076552 | A1 | 3/2008 | Baerlocher et al. |
| 2010/0167817 | A1 | 7/2010 | Anderson et al. |
| 2011/0014971 | A1 | 1/2011 | Ward et al. |

FOREIGN PATENT DOCUMENTS

| | | | |
|---|---|---|---|
| WO | 2006/076185 | A2 | 7/2006 |
| WO | 2007/089410 | A2 | 8/2007 |
| WO | 2008/030904 | A2 | 3/2008 |

OTHER PUBLICATIONS

International Search Report corresponding to International Patent Application No. PCT/US2008/012184, United States Patent Office; dated Jan. 9, 2009; 2 pages.

Written Opinion corresponding to co-pending International Patent Application Serial No. PCT/US2008/008600, United States Patent Office, dated Oct. 23, 2008.

International Search Report corresponding to co-pending International Patent Application Serial No. PCT/US2008/008600, United States Patent Office, dated Oct. 23, 2008.

International Preliminary Report on Patentability corresponding to co-pending International Patent Application Serial No. PCT/US2008/008600, United States Patent Office, dated Aug. 28, 2009.

Office Action from co-pending Australian Patent Application No. 2008276564, Dated Mar. 14, 2012.

* cited by examiner

GAMING SYSTEM HAVING GRAPHICAL USER INTERFACE FOR CONFIGURATION OF WAGERING GAMES

CROSS-REFERENCE TO RELATED APPLICATIONS

This application is a continuation of U.S. patent application Ser. No. 12/740,063, filed Apr. 27, 2010, now allowed, which is a U.S. National Stage of International Application No. PCT/US2008/012184, filed Oct. 28, 2008, which claims the benefit of U.S. Provisional Application No. 61/001,474, filed on Nov. 1, 2007, all of which are incorporated herein by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having a graphical user interface for configuration of wagering games and supplemental features.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player. One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

The present invention is directed to graphical user interfaces for configuring wagering games and supplemental features.

SUMMARY OF THE INVENTION

According to one aspect of the present invention, an operator control interface for configuration of wagering games comprises a control screen for displaying a plurality of available primary wagering games and a plurality of available supplemental features and at least one input device for receiving configuration inputs. At least one controller is operative to (i) in response to a first configuration input received via the at least one input device, add a selected primary wagering game to a first wagering game configuration, (ii) in response to a second configuration input received via the at least one input device, add a selected supplemental feature to the first wagering game configuration, and (iii) cause the control screen to display the first wagering game configuration and an overall payback percentage of the first wagering game configuration.

According to another aspect of the invention, a method of configuring wagering games via an operator control interface comprises displaying a plurality of primary wagering games in a first area of a control screen and displaying a plurality of supplemental features in a second area of the control screen. The method further comprises receiving a first input for dragging and dropping a selected primary wagering game from the first area to a third area of the control screen and displaying a wagering game configuration in the third area. The method further comprises receiving a second input for dragging and dropping a selected supplemental feature from the second area to the third area, adding the selected feature to the display of the wagering game configuration, and displaying an overall payback percentage of the wagering game configuration.

According to yet another aspect of the invention, a method of graphically creating wagering game configurations comprises receiving a first input from an operator, and in response thereto, dragging a selected primary wagering game from a first area of a control screen and dropping the selected primary wagering game to a configuration area of the control screen. The method further comprises receiving a second input from an operator, and in response thereto, dragging a selected supplemental feature from a second area of the control screen and dropping the selected supplemental feature to the configuration area. The method further comprises receiving a third input from an operator, and in response thereto, dragging a selected denomination from a third are of the control screen and dropping the selected denomination to the configuration area. The method further comprises displaying at least a first wagering game configuration in the configuration area, the first wagering game configuration comprising the selected primary wagering game, the selected supplemental feature, and the selected denomination.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
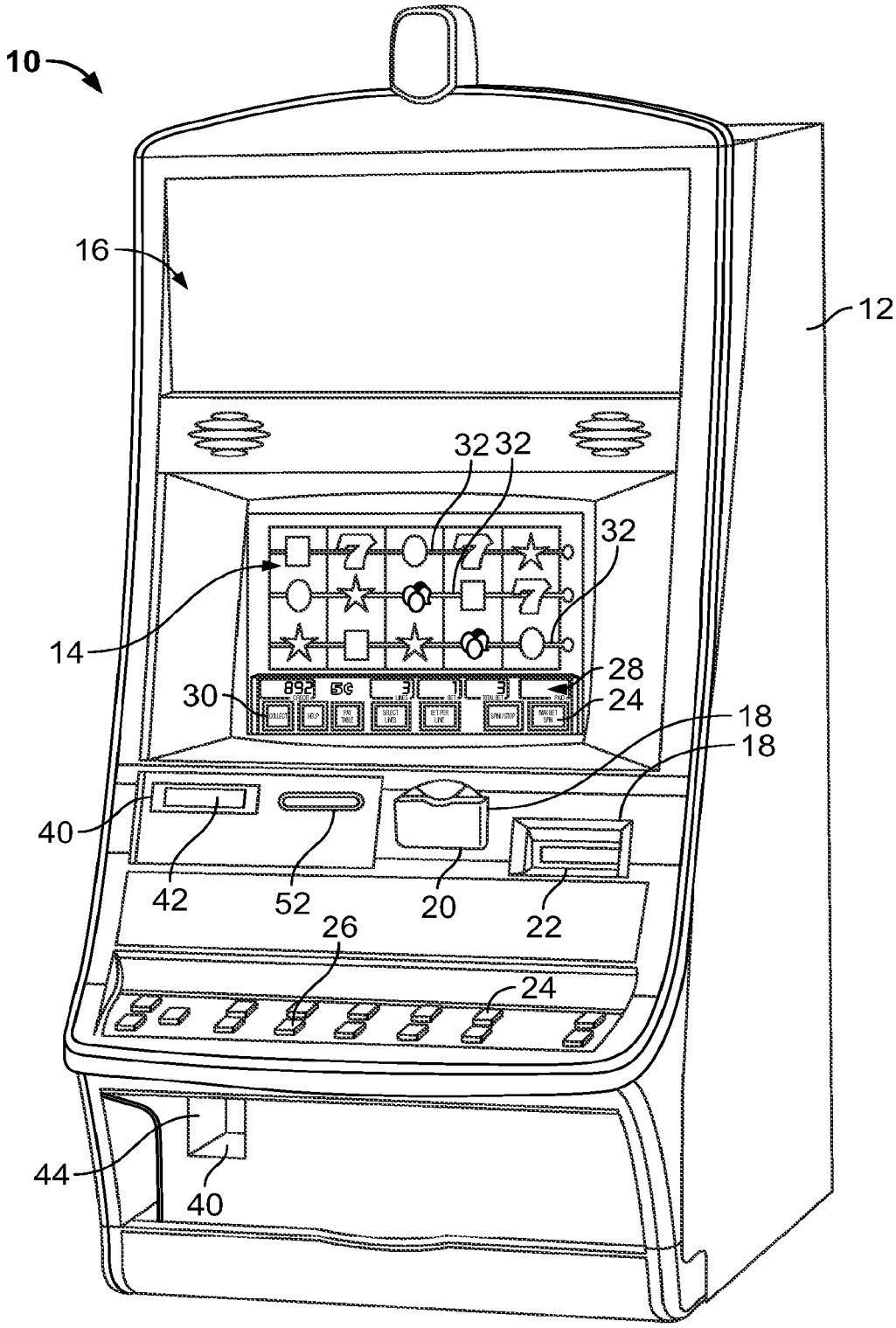
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, any other game compatible with a display comprising at least one symbol-bearing reel strip. The gaming machine 10 may also be a hybrid gaming machine integrating both electronic and electromechanical displays.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 of the gaming machine 10 may include a number of mechanical reels to display the outcome in visual association with at least one payline 32. Alternatively, the primary display 14 may take the form of a hybrid display incorporating both electromechanical display components, such as reels, with an electronic display, which may include a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
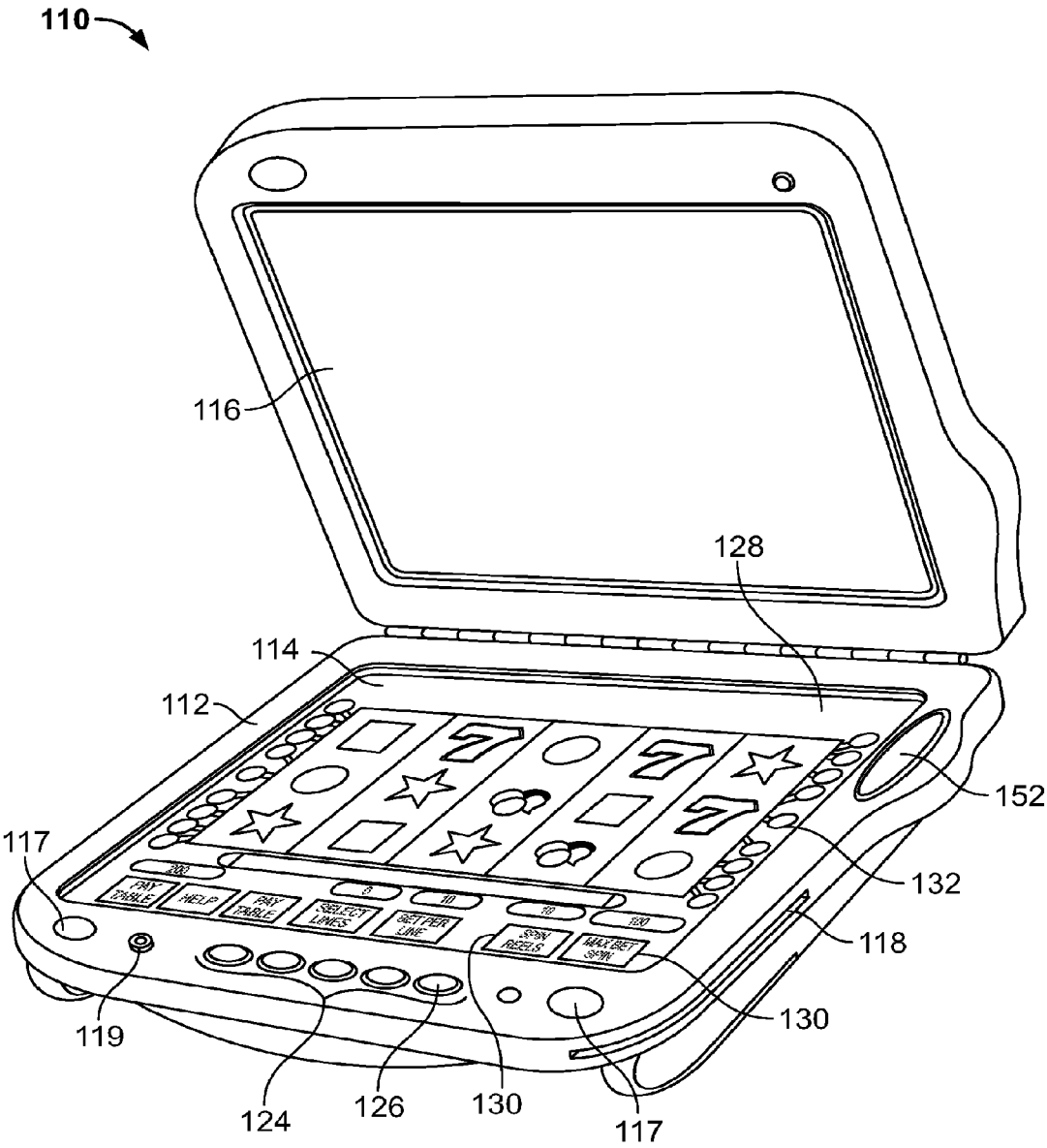
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electromechanical gaming machine configured to play mechanical slots, any other game compatible with a display comprising at least one symbol-bearing reel strip. The handheld gaming machine 110 may also be a hybrid gaming machine integrating both electronic and electromechanical displays. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons 126 may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably includes a number of mechanical reels to display the outcome in visual association with at least one payline. Alternatively, the primary display 114 may take the form of a hybrid display incorporating both electromechanical display components, such as reels, with an electronic display, which may include a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 118 or an assignment of credits stored on the handheld gaming machine via the player input device 124, e.g. the touch screen keys 130 or push buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
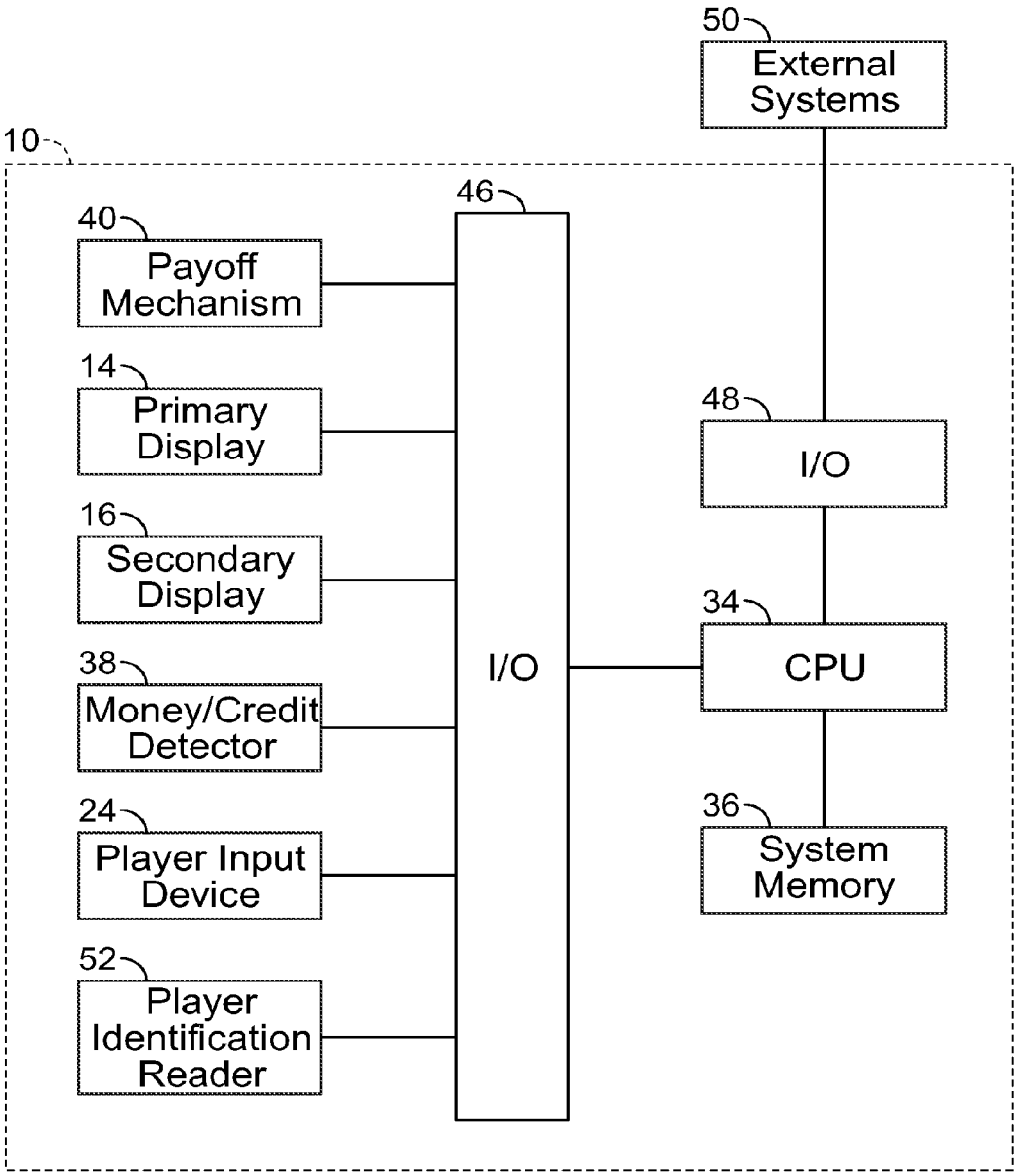
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10 bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
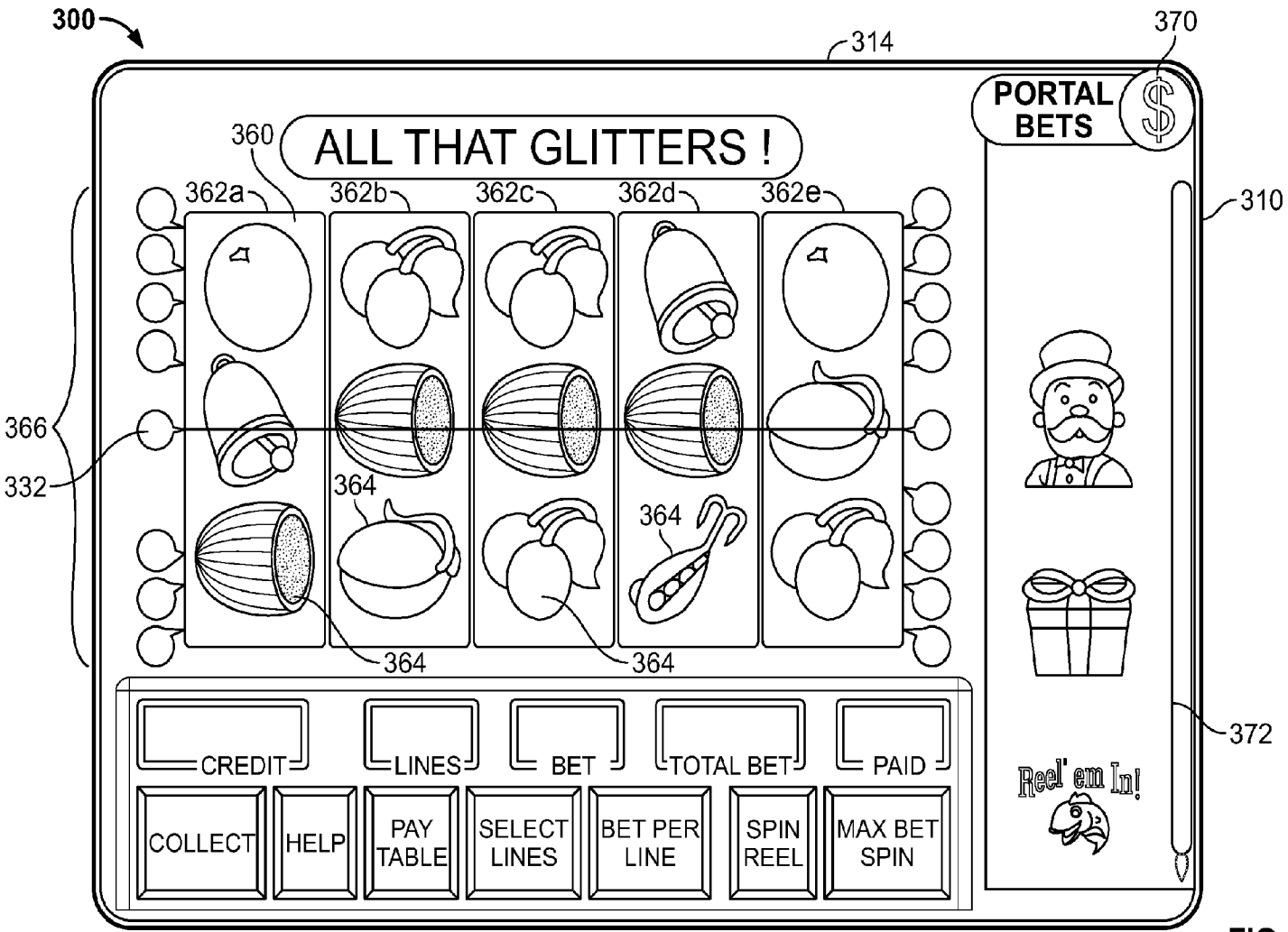
FIG. 3 is a screen shot of a primary display of a gaming system displaying a primary wagering game and a supplemental feature menu.

Turning now to FIG. 3, a primary display 314 of a first gaming device 310 of a gaming system 300 is shown. The primary display 314 may be any form of display such as those described herein with reference to the free standing and handheld gaming devices of FIGS. 1*a* and 1*b*. The primary display 314 includes a display of a primary wagering game 360, which in this embodiment is a slot game entitled "All That Glitters" as shown in FIG. 3. The slot game 360 includes a plurality of reels 362*a,b,c,d,e* which may be either electromechanical reels or simulations thereof on the primary display 314. The reels 362*a,b,c,d,e* include a plurality of symbols 364 displayed thereon that vary as the reels 362*a,b,c,d,e* are spun and stopped. The symbols 364 may include any variety of graphical symbols, elements, or representations, including symbols 364 which are associated with one or more themes of the gaming machine or system. The symbols 364 may also include a blank symbol or empty space. As described herein the symbols 364 landing on the active paylines 332 (the paylines for which a wager has been received) are evaluated for winning combinations. If a winning combination of symbols 364 lands on an active payline 332 a primary award is awarded in accordance with a pay table of the gaming device. The symbols 364 on the reels 362*a,b,c,d,e* form an array 366 or matrix of symbols 364, having a number of rows and columns, which in the embodiment shown is three rows and five columns. In alternate embodiments, the array 366 may have greater or fewer symbols 364, and may take on a variety of different forms having greater or fewer rows and/or columns. The array 366 may even comprise other non-rectangular forms or arrangements of symbols 364.

The system 300 further includes a feature icon 370 for displaying and receiving selection and activation of various supplemental features to the wagering game 360. The feature icon 370 in FIG. 3 comprises a graphical icon or button entitled "Portal Bets." In other embodiments, other icons or graphics may be utilized, and may include isolated buttons, icons, or even a graphical bar or menu, for example across the top, bottom, or side of the display 314. The feature icon 370 can be selected or activated by a player of the wagering game 360 through a touch screen (not shown) overlying the display 314, or through any other appropriate player input device as described herein with relation to FIGS. 1*a*, 1*b*, and 2.

As seen in FIG. 3, once the feature icon 370 has been selected or activated, a feature menu 372 is displayed on the primary display 314 of the system 300. The feature menu 372 includes and displays a plurality of available features which are provided for activation or selection in addition to the primary wagering game 360. In FIG. 3, three features have been activated by an operator of the gaming system 300, and thus the feature menu 372 displays the three features 374*a,b,c* graphically, which include a Monopoly feature 374*a*, a Jackpot Party feature 374*b*, and a Reel 'Em In feature 374*c*.

Any number of wagering-game features 374 may be made available to be activated by a player of the gaming system 300. The features 374 may include any number of improvements, additions, enhancements, or modifications of a standard basic wagering game experience displayed on the primary display 314. For example, the features 374 may include eligibility or participation in bonus games, progressive jackpots or awards, or community games or events, including group games, team competitions, and competitive or collaborative play. The features 374 may also include wagering game assets such as free spins, wild symbols, multipliers, symbol upgrades, expanding wild symbols, scatter symbols, etc. The features 374 may also include eligibility or participation in secondary wagering games, side-bet games, reel re-spins, or extra chances or opportunities during play of the primary wagering games.

In other embodiments, the features 374 that may be activated may include features usable in a selection game, such as additional selections, opportunities to replace or re-do a prior selection, opportunities to undo a poor selection or selection of a terminating symbol, etc. Moreover, the features 374 may include eligibility or participation in enhanced awards, improvements of randomly selected outcomes of a primary wagering game, advancement to higher levels of play, advancement to newer or more favorable episodes of wagering games, etc. In yet other embodiments, features 374 may include eligibility and participation in additional wagering games, other games within a casino or gaming establishment (e.g., other table games or electronic games), wide area progressive jackpots, local area progressive jackpots, tangible prize awards, player reward points and loyalty programs, etc. The features 374 of the gaming system 300 as described herein may comprise any feature available on a wagering game which may be funded by an increased wager, a side wager, a secondary or separate wager, via player reward points, or in any other manner utilizing any form of currency, monetary input or other value.

It should also be understood that the features 374 activated in the system 300 of the present invention may be any number of available wagering game features as described herein. Moreover, the features may include any enhancements or additions to the primary wagering game as described in detail in U.S. Patent Application Ser. No. 60/844,032 filed on Sep. 12, 2006, and US. Patent Application Ser. No. 60/802,984 filed on May 24, 2006, both of which are assigned to WMS Gaming Inc. Both such applications are hereby incorporated by reference, in their entirety, as if full set forth herein.

Figure 4:
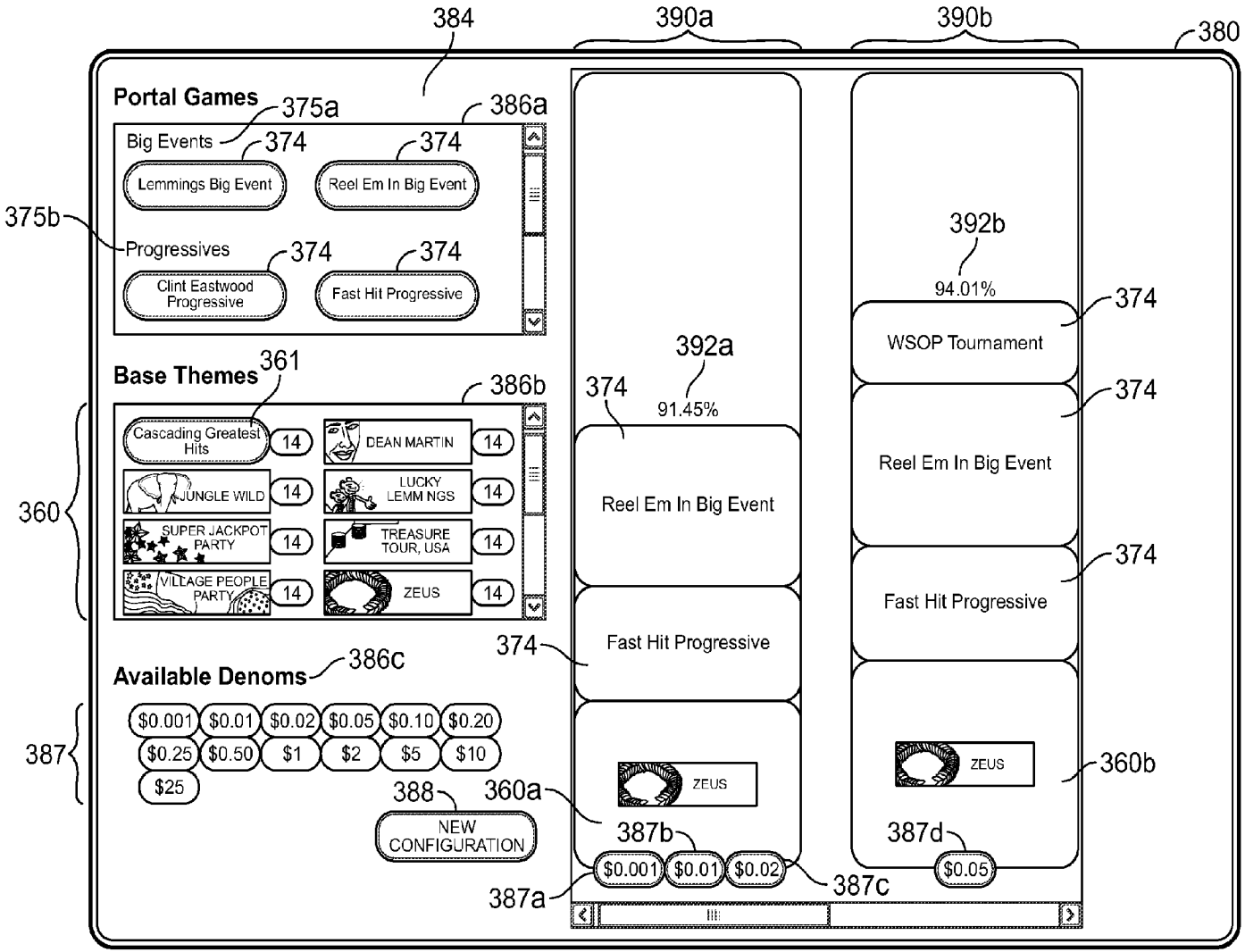
FIG. 4 is a screen shot of a control terminal for configuring supplemental features for use with one or more primary wagering games.

Turning to FIG. 4, an operator control interface 380 of the gaming system 300 is depicted. The operator control interface 380 includes a plurality of configuration screens for configuring the primary wagering game 360 displayed on the first gaming device 310, and for configuring other wagering games displayed on other gaming devices throughout the operator's establishment, for example, a casino. In an embodiment, the operator control interface 380 is in communication with, and forms part of, an operator control terminal through which one or more gaming functions of the operator's establishment are controlled. The operator control terminal may be in communication with one or more servers, utilizing wired and/or wireless network communications. The network may in turn be connected to other servers, gaming devices, computers, and control systems. The operator control terminal includes one or more input devices, such as a touch screen overlying the operator control interface 380, a mouse, and a keyboard, for receiving inputs from the operator to control the wagering games within the operator's establishment.

In alternative embodiments, the operator control interface 380 may be located elsewhere as part of the gaming system 300. For example, the operator control interface 380 may be viewable and usable on one or more gaming devices 310 in the system. For example, through a menu system, an operator may be able to recall the operator control interface 380 so as to appear on the primary display 314 of a gaming device 310, such as those shown and described with reference to FIGS. 1*a* and 1*b*. Moreover, the operator control interface 380 may appear on a handheld device, such as a handheld gaming device, or a handheld configuration computer which is in communication with the other components of the system 300 through wireless communications over a network. Thus, the operator control interface 380 may be provided in one or more locations throughout the system 300, including one or more gaming devices (freestanding or handheld), one or more operator control computers (freestanding or handheld), or through any other appropriate hardware having a display thereon, and at least one input device.

In FIG. 4, a control screen 384 is displayed on the operator control interface 380. The control screen 384 includes a plurality of categories 386 corresponding to attributes of the wagering games in the operator's facility which the operator can customize or control. For example, the categories 386 include Portal Games 386*a* which is a window in which are listed various supplemental features 374 available on the system 300 to the operator. Another category 386 is Base Themes 386*a* which lists primary wagering games 360 available on the system, by name of the themes of such games. Yet another category 386 is an Available Denoms 386*c* category which shows the available denominations 387 for primary wagers which can be configured by an operator. A new configuration button 388 is displayed below the categories which can be used to activate and control a new configuration setup of wagering games.

The Portal Games category 386*a* includes display of a plurality of supplemental features 374 which are organized and displayed in groups 375. In one embodiment, as shown in FIG. 4, the groups 375 comprise different types of features 374. For example, in a first group 375*a* are displayed features 374 which are "Big Event" community style features 374. In a second group 375*b* are displayed features 374 which are "Progressive" type features, such as progressive jackpots. Other groups 375 may be included in the Portal Games category 386*a*, but not visible until the category 386*a* is scrolled down using the menu bar slider on the right side of the Portal Games category 386*a* window.

In the Base Themes category 386*b* window are displayed a plurality of primary wagering games 360 available on the system for play and configuration. The primary wagering games 360 may be displayed graphically or using text, or both. Moreover, the primary wagering games 360 may be individually displayed by theme or title (such as "Jungle Wild," "Super Jackpot Party," or "Zeus"), or may also be displayed in sets 361 (such as "Cascading Greatest Hits"). Thus, a theme set 361 may be used and labeled to group a plurality of primary wagering games 360 together which have a common element, feature, or association. In the example shown, the games in the theme set 361 all have game play in which the symbols "cascade" or fall into the array rather than reels which spin and stop to display symbols. Other primary wagering games 360 and sets 361 may be displayed in the Base Themes category 386*b*, but not visible until the category 386*b* is scrolled down using the menu bar slider on the right side of the Base Themes category 386*b* window.

On a right side of the control screen 384 are one or more configurations 390*a,b* which are displayed as active once configured and activated by the operator. Each configuration includes a Base Theme, or primary wagering game 360*a,b* as well as, optionally, one or more Portal Games, or supplemental features 374. Moreover, each configuration 390*a,b* is specific to one or more denominations 387 as displayed along the bottom of the configuration 390*a,b*. Thus, the first configuration 390*a* applies only to the associated denominations 387*a,b,c* of $0.001, $0.01 and $0.02, respectively, while the second configuration 390*b* applied only to its associated denomination 387*d* of $0.05. An overall payback percentage 392*a,b* for each configuration 390*a,b* is associated with and displayed for each configuration 390*a,b* created by the operator.

The control screen 384 and operator control interface 380 employ drag and drop technology via one or more input devices such that the operator control interface 380 provides a graphical user input for receiving operator configurations of wagering games. Thus, in the embodiment shown, an operator creates a new configuration 390 by pressing the new configuration button 388. Once created, the operator first selects a Base Theme, or primary wagering game 360, from the Base Themes category 386*b* by selecting the theme and dragging and dropping it onto the newly created configuration 390 bar. Once dropped on the new configuration 390, the Base Theme 360 appears near the bottom of the new configuration 390. The operator then selects one or more Portal Games, or supplement features 374, and drags and drops them in succession onto the new configuration 390. They are visually stacked on top of the Base Theme 374 in the order that they are selected.

The operator also selects the denominations 387 for which he desires the new configuration 390 to be active by dragging and dropping denominations 387 from the Available Denom category 386*c* to the new configuration 390. The activated denominations 387 are thus displayed along the bottom of the new configuration 390 underneath the Base Theme 360. The dragging and dropping may be accomplished using a touch screen overlying the operator control interface 380 and control screen 384, or via an external input device such as a mouse, trackball, pointer, or other device. The operator can continue creating additional new configurations in the same manner which are displayed next to one another, and are also capable of being navigated using the menu slider bar along the bottom of the control screen 384

It should be understood that the listing of primary wagering games 360 in the Base Themes category 386*b* includes a listing of icons, identifiers, or labels associated with the relevant primary wagering games 360. Thus, the primary wagering games 360 in the Base Themes category 386*b* need not be the games 360 themselves, but instead may be textual listings, graphical icons, or other representations of the games 360. When the drag and drop technology is employed on the control screen 384, an operator may drag and drop an icon or other representation of the primary wagering game 360 in the Base Themes category 386*b* to the new configuration 390. Thus, as used herein, dragging and dropping "a Base Theme or primary wagering game 360," for example, refers to dragging an icon, identifier, or other representation of the primary wagering game 360 from one area of the control screen 384, and placing it or "dropping it" on another area of the control screen 384.

Similarly, the supplemental features 374 listed in the Portal Games category 386*a* may be represented by icons, identifiers, labels, or other representations. Thus, as used herein, dragging and dropping "a Portal Game or supplemental feature 374", for example, refers to dragging an icon, identifier, or other representation of the supplemental feature 374 from one area of the control screen 384, and placing it or "dropping it" on another area of the control screen 384. Similarly, the denominations 387 displayed in the Available Denoms category 386*c* may be icons, identifiers, labels or other representations of available denominations 387. As used herein, dragging and dropping "an Available Denom or denomination 387," for example, refers to dragging an icon, identifier, or other representation of the denomination 387 from one area of the control screen 384, and placing it or "dropping it" on another area of the control screen 384. In alternative embodiments, other elements on the control screen 384 which are capable of "drag and drop" manipulation may also be visually represented on the control screen 384 by an icon, label, identifier or other representation.

Figure 5:
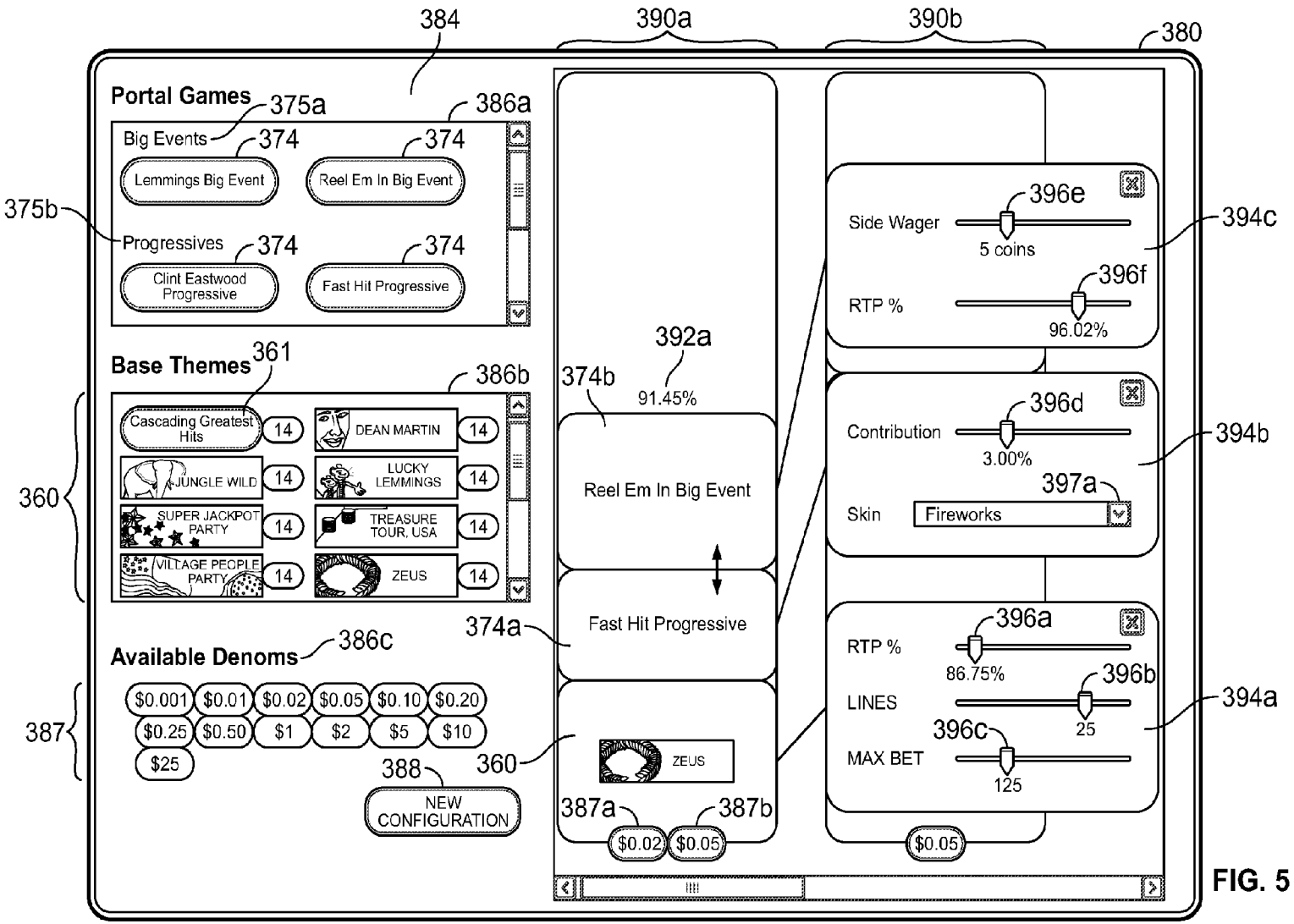
FIG. 5 is a screen shot of the control terminal of FIG. 4, showing an operator activating and configuring supplemental features.

Turning to FIG. 5, the control screen 384 and operator control interface 380 are shown wherein an operator is configuring individual elements of the available configurations 390*a,b*. Thus, for the first configuration 390*a*, a plurality of configuration pop-up windows 394*a,b,c* are shown corresponding to the various elements of the configuration 390*a*. For example, a first configuration pop-up window 394*a* corresponds to configuration of the Base Theme 360*a*, which in this embodiment is a "Zeus" primary wagering game 360*a*. The pop-up window 390*a* includes slider bars 396*a,b,c* for configuring various aspects of the Base Theme 360*a*. A first slider bar 396*a* is used for configuration of a primary payback percentage (RTP %) of the Base Theme 360*a*. A second slider bar 396*b* is used to configure a number of paylines available to be played on the selected Base Theme 360*a*. Finally, a third slider bar 396*c* is used to configure a maximum wager (Max Bet) for the Base Theme 360*a*. Each of the slider bars 396*a,b,c* is manipulated using the input device (e.g. touch screen) to slide the slider bar 396*a,b,c* left and right until the desired number for the configuration element is reached.

Similarly, the second configuration pop-up window 394*b* is used to configure aspects of the first Portal Game, or supplement feature 374*a*, on the configuration 390*a*, which in this case is a "Fast Hit Progressive" feature 374*a*. The pop-up window 394*b* includes another slider bar 396*d* for configuring a feature payback percentage or a "contribution" percentage. The pop-up window 394*b* further includes a pull down menu 397*a* for configuring an appearance or "skin" of the feature 374*a*. As seen in FIG. 5, the selected skin is "fireworks" which signifies that the feature 374*a* will include a fireworks themed overlay or appearance.

The third configuration pop-up window 394*c* corresponds to a second Portal Game, or supplemental feature 374*b* of the configuration 390*a*, which in this embodiment is a "Reel Em In Big Event" feature 374*b*. The pop-up window 394*c* includes yet more slider bars 396*e,f* for configuring various aspects of the associated Portal Game 374*b*. In this case, one slider bar 396*e* is used for configuring a side wager amount for the feature 374*b*. Another slider bar 396*f* is used for configuring a feature payback percentage (RTP %) for the selected feature 374*b*.

The various configurations performed in the configuration pop-up windows 394*a,b,c* affect the overall configuration 390*a* displayed. Thus, for example, the overall payback percentage 392*a* for the configuration 390*a* may be affected by various changes in the configurations of the configuration pop-up windows 394*a,b,c*. In one example, the overall payback percentage 392*a* is a function of, among other things, the size of the side wager and the feature payback percentage of the second Portal Game 374*b*, as displayed in the third configuration pop-up window 394*c*. Adjusting the feature payback percentage via the relevant slider 396*f* affects the overall payback percentage 392*a* displayed for the configuration 390*a*. Thus, the configuration 390*a* is dynamic and is displayed in real time or near real time, such that as one or more aspects of the configuration pop-up windows 394*a,b,c* are adjusted, the overall payback percentage 392*a* is dynamically updated. In this way, an operator is able to see the effects of particular adjustments in the pop-up windows 396*a,b,c* on the overall configuration 390*a*. Moreover, the size of the graphical windows of the elements of the configuration 390*a* may be adjusted to show relative changes in the payback percentages. Thus, changing the payback percentage of the selected Base Theme 360*a*, or selected features 374*a,b* causes the window around them to increase or decrease in size, and further causes the overall height of the stacked elements to increase or decrease as the overall payback percentage 392*a* increases or decreases as well. This gives the operator a visual impression of the configuration 390*a* as the height of the configuration 390*a*, as well as the size of the elements 360*a*,374*a,b* therein, change in response to adjustments of the slider bars 396.

Figure 6:
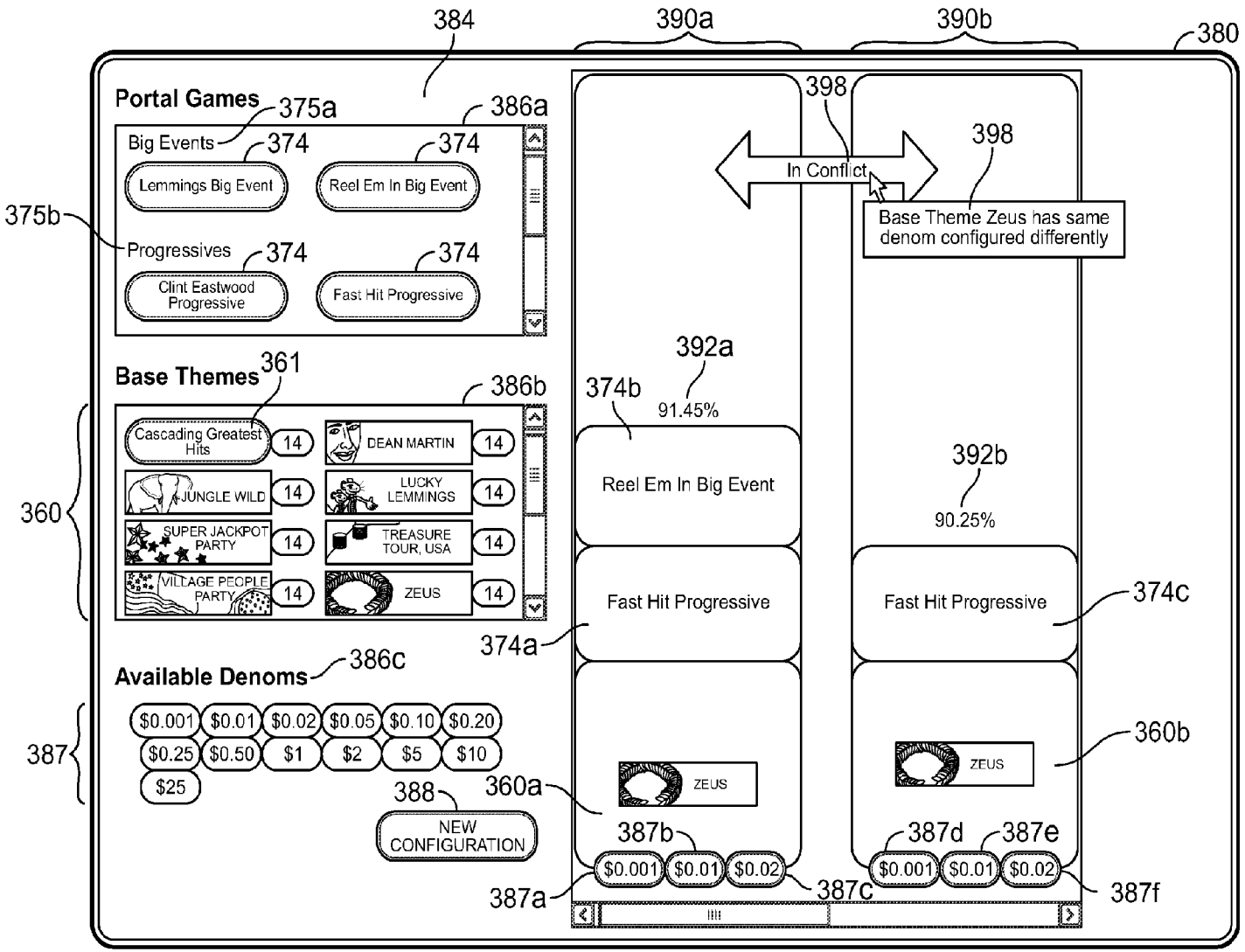
FIG. 6 is a further screen shot of the control terminal of FIG. 4, showing a conflict in wagering game configurations.

Turning to FIG. 6, another view of the operator control interface 380 is shown in which two configurations 390*a,b* have been created and activated by the operator. In the embodiment shown, the operator has selected the $0.001, $0.01 and $0.02 denominations 387*a,b,c* for the first configuration 390*a*, which includes the Base Theme 360*a* "Zeus." The operator has mistakenly selected the same $0.001, $0.01 and $0.02 denominations 387*d,e,f* for the second configuration 390*b*, which also has the Base Theme 360*b* "Zeus." This creates a conflict in the configuration because the same Base Theme 360*a,b* cannot be configured differently (two configurations 390*a,b*) for the same denomination 387. Thus, a conflict notification 398 is displayed on the control screen 384 of the operator control interface 380. In this embodiment, the conflict notification informs the operator of the conflict between the two configurations 390*a,b* (the words "In Conflict" and the arrows indicating the affected configurations 390*a,b*), as well as indicates to the operator the nature of the conflict ("Base Theme Zeus has same denom configured differently"). Thus, the conflict notification 398 is used to indicate to the operator that two or more of the active configurations 390*a,b* are in conflict and include configurations which are not permissible under one or more rule sets governing the operator control interface 380. The conflict notification 398 may include other elements to help highlight and signify the conflict. For example, background colors, shading, etc. on the various components of the configurations 390*a,b* may be changed to emphasize the conflict. In one embodiment, for any two configurations 390*a,b* in conflict, the background color of the configuration 390*a,b* bars is changed to red.

Figure 7:
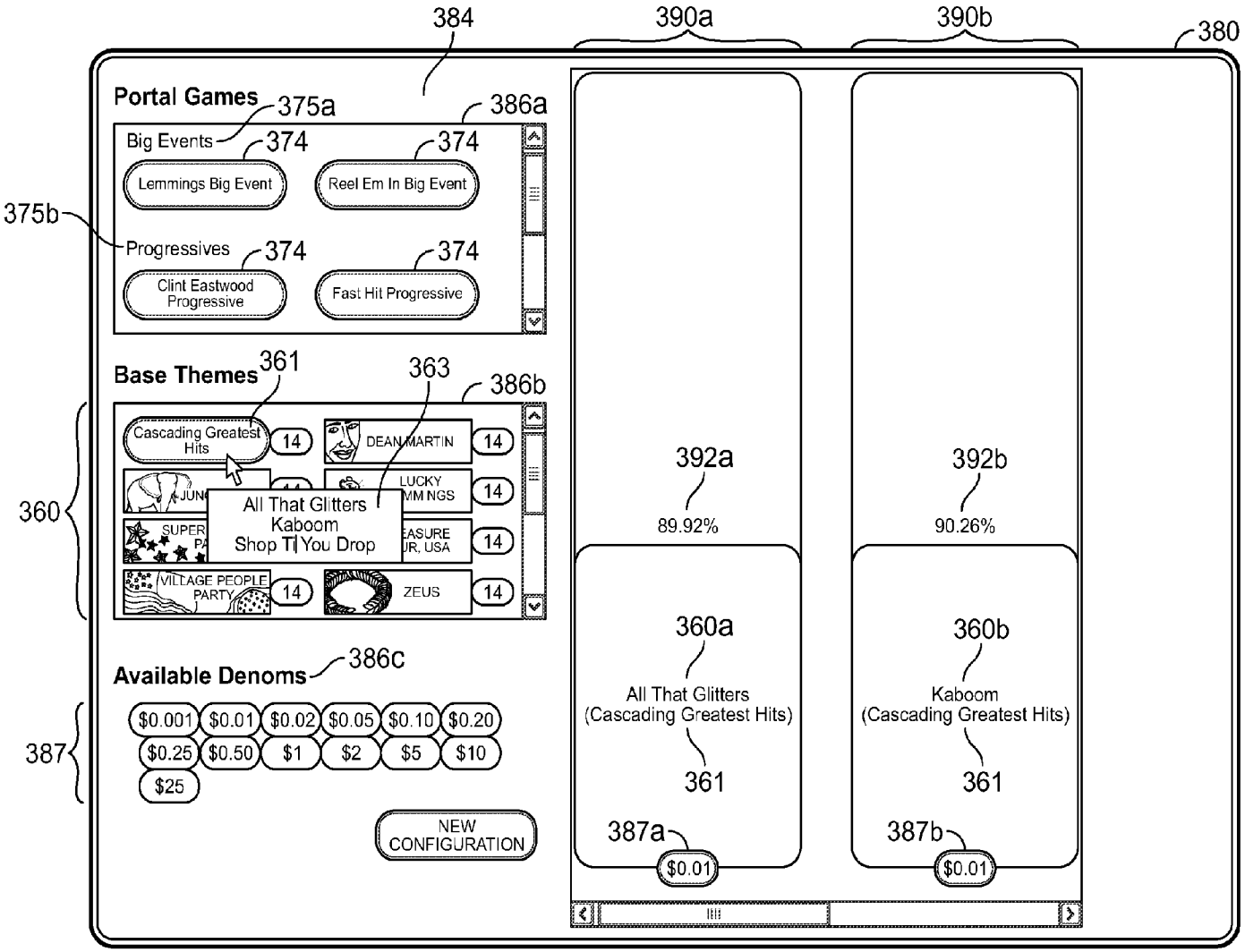
FIG. 7 is another screen shot of the control terminal of FIG. 4, showing configuration of a themed set of wagering games.

Turning to FIG. 7, the operator control interface 380 and control screen 384 are again displayed wherein the operator is configuring one or more theme sets 361. By touching, mousing over, or clicking an available theme set 361 in the Base Themes category 386*b*, a theme set contents window 363 pops up and displays the primary wagering games 360 contained in the theme set 361. In this way, an operator can decide if the Base Themes 360 contained in the theme set 361 are those which the operator wishes to activate and configure. In the embodiment shown, the "Cascading Greatest Hits" theme set 361 includes the primary wagering games 360 of "All That Glitters" 360*a*, "Kaboom" 360*b* and "Shop Til You Drop" 360*c*, which are displayed in the theme set contents window 363. The operator uses the same input technique to drag and drop the selected theme set 361 to the right side of the configuration screen 384. By doing so, the theme set 361 is opened, and a new configuration 390*a,b* is opened for each of the primary wagering games 360*a,b* in the theme set 361. Thus, a first configuration 390*a* corresponds to a first primary wagering game 360*a* ("All That Glitters") of the theme set 361. Similarly, a second configuration 390*b* corresponds to a second primary wagering game 360*b* ("Kaboom") of the theme set 361. A third configuration (not shown) is opened for the third primary wagering game 360*c* ("Shop Til You Drop") of the theme set 361, and may be accessed by manipulation of the menu bar at the bottom of the control screen 384.

As before, each of the configurations 390*a,b* includes a display of an overall payback percentage 392*a,b*. Moreover, each configuration 390*a,b* displays both the name of the primary wagering game 360*a*, as well as (in parentheses) the name of the theme set 361 (Cascading Greatest Hits) to which it belongs. Also as explained before, each configuration 390*a,b* is still configurable by denomination 387*a,b*. Thus, although a new configuration 390*a,b* is created for each Base Theme 360*a,b* in the theme set 361, the operator can still make one configuration 390*a* available on certain denominations 387*a*, while a second configuration 390*b* is available on other denominations 387*b*. In the embodiment shown, the operator is free to drag and drop Portal Games 374 to the various configurations 390*a,b*. Because the configurations 390*a,b* are associated with a theme set 361, dragging and dropping a Portal Game 374 onto one of the configurations 390*a,b* will cause it to be added to all of the configurations 390*a,b* for that theme set. Of course, the operator can remove features 374 from certain configurations 390*a,b* should he see fit to do so. The operator may also remove entire configurations 390*a,b* if they are undesirable, or may modify their configurations as he sees fit.

In alternative embodiments, a large variety of input commands may be usable by the operator through any appropriate input device, such as a touch screen or mouse. The operator can remove Base Themes 360 and Portal Games 374 by dragging and dropping off of the configuration 390, or by using a delete keystroke or mouse click. Entire configurations 390 may be removed in a similar fashion, or may copied, cut, pasted, etc. Moreover, various elements can be set as default parameters, such as default denominations 387, numbers of paylines, payback percentages, etc. Various colors may be used as well. For example, a selected color may be used to signify default components, such that an operator can tell whether a particular configuration 390 includes components which have been modified or not. Moreover, using the input devices discussed, an operator can change the default components for future use.

As used herein the term "theme" or "themes" is used to signify one or more of the base games, also referred to as "primary wagering games," such as the one displayed in FIG. 3. "Portal games" refers to, and may be utilized interchangeably with the words "supplemental features," and signifies one or more supplemental features, games, or activities in which a player may participate in addition to playing one of the primary wagering games.

As used herein, a "payback percentage" refers to one or more numbers which signify a theoretical mathematical value associated with a gaming device or system indicating a theoretical percentage or proportion of wagers which will be either returned to players via awards or retained by an operator of the gaming device or system. One example of a payback percentage is referred to as a "payout percentage," which is a theoretical average percentage of all wagers input into a gaming device or system which are returned or dispensed to players in the form of awards. Another example is a "hold percentage" which is the theoretical average percentage of all wagers input into a gaming device or system that are held, earned or retained by an operator of the gaming device or system. A payout percentage and a hold percentage are related in that they sum to 100%. For example, if a gaming device has a 95% payout percentage, it will have a 5% hold percentage. This means that over many plays of wagering games on the gaming device, a theoretical 95% of all wagers input into the device will be dispensed or returned to players in the form of one or more awards. Likewise, a theoretical 5% of all wagers input into the device will be retained by the operator. A "payback percentage" as used herein can be a payout percentage, a hold percentage, or any other number or index which indicates or provides information relating to mathematical probabilities and theoretical expectations as to what portion of wagers input into a gaming system will be returned and/or what portion will be retained or held.

As described, in an embodiment, selection and activation of one of the features 374 requires input of an additional wager in the form of a secondary wager, side bet, or other monetary input. Thus, in one embodiment, selection of a desired feature 374 causes a player's wager account to be debited in an appropriate amount associated with the feature. In an alternative embodiment, one or more of the features 374 may be activated or selected without placing additional wagers or incurring additional fees. In yet another alternative embodiment, the cost of additional features 374 may be debited from or supplied by player loyalty points, frequent player points, comps, player tracking card points, a designated feature fund, or other collected secondary economy accounts, instead of or in addition to currency wagers.

An overall payback percentage 392 displayed on a configuration 390 is calculated automatically, for the activated denomination, and is a function of the primary payback percentage of the Installed Theme 360, the wager amount on the primary wagering game (a minimum qualifying primary wager), a feature payback percentage of any activated feature 374, and any Side Bet amount required to play the feature 374.

An overall payback percentage 392 of a configuration 390 (the payback percentage of the primary wagering game 360 plus one or more activated portal games or supplemental features) may be calculated as a function of the primary payback percentage (the payback percentage of the primary wagering game 360) as well as the feature payback percentages of any of the portal games or features 374 which have been enabled. When activated, the primary wagering game 360 is configured or set to a primary payback percentage (as seen in FIG. 5, for "Zeus" theme it is 86.75%), which can be the same or different based upon denomination. This primary payback percentage may be adjusted (upward or downward) in response to activation of one or more of the portal games 374. Each of the portal games has its own corresponding feature payback percentage (see FIG. 5, for example, "Reel Em In Big Event" feature 374 has a 96.02% feature payback percentage) that may be higher or lower than the corresponding primary payback percentage. Thus, the overall payback percentage for each denomination is a function of, and affected by, the feature payback percentages of each activated features. The overall payback percentage is also a function of the relative sizes of the primary wager (the minimum qualifying primary wager of the primary wagering game 360 making the player eligible to play the supplemental feature) and any required supplemental wagers (Side Bets) for activating the selected portal game. Thus, in an embodiment, the overall payback percentage is given by Equation 1 below, wherein "OPP" stands for overall payback percentage, "PPP" stands for primary payback percentage, and "FPP" stands for feature payback percentage:

$$OPP = \frac{(PPP)(\text{Bet}_{Primary}) + (FPP_1)(\text{Side Bet}_1) + (FPP_2)(\text{Side Bet}_2)}{\text{Bet}_{Total}} \quad \text{Equation 1}$$

As seen, changes in the payback percentages of either the primary wagering game or any of the activated bonus features affect the overall payback percentage. Moreover, changes in the unit Side Bet amount also affect the overall payback percentage of a primary wagering game (per denomination). Also, activation of additional bonus features would further affect the overall payback percentage. Thus, for a primary wagering game having a primary payback percentage and a minimum qualifying primary wager, having at least one bonus feature activated, the general equation for the overall payback percentage is given in Equation 2, where N features are enabled, each having a unit Side Bet amount:

$$OPP = \frac{(PPP)(\text{Wager}_{Primary}) + \sum_{X=1}^{N} (FPP_X)(\text{Side Bet}_X)}{\text{Bet}_{Total}} \quad \text{Equation 2}$$

In an embodiment, activation of successive additional features 374 causes the overall payback percentage to increase. In other words, with each successive feature that is enabled, the overall payback percentage increases due to the addition of a feature 374 having a higher payback percentage. However, although features 374 having increasingly higher payback percentages are permitted to be activated, in an embodiment one or more rules of a rule set may limit the overall payback percentage to be within a predefined range. Thus, for example, the overall payback percentage of a particular base game theme and one or more activated portal games may be limited, for example, to be within the range of 80% to 98%. Other embodiments and configurations are possible as well. Various controls or mechanisms may be used by the rule set to accomplish such a limiting function. For example, features 374 or subsets thereof may be deactivated so as to be unable to be selected if activation would force the overall payback percentage out of the allowable range.

The control screen 384 and other elements displayed to the operator in the FIGURES herein are only examples of possible configurations of the system 300. Many other configurations may be used so as to allow an operator to view, select, and configure primary wagering games and available portal games and supplemental features. The various configurations may use graphical displays to visually link supplemental features with primary wagering games. Moreover, the control screen may permit configuration of parameters of wagering games beyond those described herein and displayed in the FIGURES. In alternative embodiment, the control screen 384 is contained in a handheld device which the operator may use to configure one or more primary wagering games and/or features as he walks through a casino floor, for example. In such an embodiment, the handheld device may be in communication with a central configuration server or computer, or the handheld device itself may comprise the control terminal discussed herein.

The system 300 as described and shown in various embodiments herein, offers a number of advantages over traditional systems. The operator control interface 380 allows a casino operator to quickly and easily navigate and configure primary wagering games and available portal games (or supplemental features) throughout the casino, by using a unique graphical user interface which permits drag and drop configuration. By using the interface 380, the operator can quickly view the overall payback percentage, by denomination, of various combinations of primary wagering games and supplemental features. This allows the operator to customize and hone in on a desired overall payback percentage by adjusting the type and number of supplemental features enabled, the side bets required thereon, and the payback percentages of the features. Moreover, the operator can create customized packages of primary games and supplemental games, and save such configurations, such that they are available for easy recall. In this way, the system acts to provide an operator with a new and improved method of controlling a casino floor. The system allows easy, quick, and informed association and disassociation of supplemental features with primary wagering games through the use of the graphical user interface of the operator control interface.

Each of these embodiments and obvious variations thereof is contemplated as falling within the spirit and scope of the claimed invention, which is set forth in the following claims.

What is claimed is:

1. A method of configuring a wagering game using an operator control interface, comprising:

displaying in one or more selection areas of a control screen a plurality of representations each associated with a primary wagering game or a supplemental game feature;

displaying a wagering game configuration as a configuration window in a configuration area of the control screen;

receiving, via the operator control interface, a first input indicating a selection of a first selected representation of the representations from the one or more selection areas;

responsive to receiving the selection of the selected first representation, adding the first selected representation to the configuration window;

receiving, via the operator control interface, a second input indicating a selection of a second selected representation of the representations from the one or more selection areas; and responsive to receiving the selection of the second selected representation, adding the second selected representation to the configuration window.

2. The method of claim 1, wherein the plurality of representations includes a plurality of primary wagering games available for selection and a plurality of supplemental game features associated with each of the primary wagering games, wherein the displaying the plurality of representations includes:

displaying the primary wagering games in a first selection area of the one or more selection areas; and displaying, in a second selection area of the one or more selection areas, the supplemental game features associated with each of the primary wagering games.

3. The method of claim 1, further comprising, responsive to receiving a third input to modify a number or index associated with the first or second selected representation, adjusting a size of the first or second selected representation within the configuration window.

4. The method of claim 3, wherein the number or index is a payback percentage associated with the first or second selected representation.

5. The method of claim 4, wherein the first selected representation corresponds to a primary wagering game and the second selected representation corresponds to a supplemental game feature associated with the primary wagering game, wherein the payback percentage associated with the primary wagering game corresponding to the first selected representation is a primary payback percentage, and wherein the payback percentage associated with the supplemental game feature corresponding to the second selected representation is a feature payback percentage.

6. The method of claim 1, further comprising:

causing the control screen to display in the configuration window an overall payback percentage in response to adding the first selected representation to the configuration window; and dynamically updating the overall payback percentage in response to the second selected representation being added to the configuration window.

7. The method of claim 6, further comprising receiving a third input to modify a payback percentage associated with the first or second selected representation and, responsive thereto, dynamically updating the overall payback percentage based on the modified payback percentage.

8. The method of claim 1, wherein the second selected representation is visually stacked on top of the first selected representation in the configuration window.

9. The method of claim 1, wherein the first selected representation corresponds to a primary wagering game and wherein the second selected representation corresponds to a supplemental game feature associated with the primary wagering game, and wherein the first selected representation includes a first window within the configuration window and wherein the second selected representation includes a second window within the configuration window, wherein a size of the first window is commensurate with a number or index associated with the primary wagering game corresponding to the first selected representation and wherein a size of the second window is commensurate with a number or index associated with the supplemental game feature corresponding to the second selected representation.

10. One or more physical machine-readable storage media including instructions which, when executed by one or more processors, cause the one or more processors to perform operations for configuring a wagering game using an operator control interface, the operations comprising:

displaying in one or more selection areas of a control screen a plurality of representations each associated with a primary wagering game or a supplemental game feature;

displaying a wagering game configuration as a configuration window in a configuration area of the control screen;

receiving, via the operator control interface, a first input indicating a selection of a first selected representation of the representations from the one or more selection areas;

responsive to receiving the selection of the selected first representation, adding the first selected representation to the configuration window;

receiving, via the operator control interface, a second input indicating a selection of a second selected representation of the representations from the one or more selection areas; and responsive to receiving the selection of the second selected representation, adding the second selected representation to the configuration window.

11. The physical machine-readable storage media of claim 10, wherein the plurality of representations includes a plurality of primary wagering games available for selection and a plurality of supplemental game features associated with each of the primary wagering games, wherein the displaying the plurality of representations includes:

displaying the primary wagering games in a first selection area of the one or more selection areas; and displaying, in a second selection area of the one or more selection areas, the supplemental game features associated with each of the primary wagering games.

12. The physical machine-readable storage media of claim 10, the operations further comprising, responsive to receiving a third input to modify a number or index associated with the first or second selected representation, adjusting a size of the first or second selected representation within the configuration window.

13. The physical machine-readable storage media of claim 12, wherein the number or index is a payback percentage associated with the first or second selected representation.

14. The physical machine-readable storage media of claim 13, wherein the first selected representation corresponds to a primary wagering game and the second selected representation corresponds to a supplemental game feature associated with the primary wagering game, wherein the payback percentage associated with the primary wagering game corresponding to the first selected representation is a primary payback percentage, and wherein the payback percentage associated with the supplemental game feature corresponding to the second selected representation is a feature payback percentage.

15. The physical machine-readable storage media of claim 10, the operations further comprising:

causing the control screen to display in the configuration window an overall payback percentage in response to adding the first selected representation to the configuration window; and dynamically updating the overall payback percentage in response to the second selected representation being added to the configuration window.

16. The physical machine-readable storage media of claim 15, further comprising receiving a third input to modify a payback percentage associated with the first or second selected representation and, responsive thereto, dynamically updating the overall payback percentage based on the modified payback percentage.

17. The physical machine-readable storage media of claim 10, wherein the second selected representation is visually stacked on top of the first selected representation in the configuration window.

18. The physical machine-readable storage media of claim 10, wherein the first selected representation corresponds to a primary wagering game and wherein the second selected representation corresponds to a supplemental game feature associated with the primary wagering game, and wherein the first selected representation includes a first window within the configuration window and wherein the second selected representation includes a second window within the configuration window, wherein a size of the first window is commensurate with a number or index associated with the primary wagering game corresponding to the first selected representation and wherein a size of the second window is commensurate with a number or index associated with the supplemental game feature corresponding to the second selected representation.

19. A system for configuring a wagering game using an operator control interface, comprising:

an operator control interface;

a display device; and one or more controllers configured to:

display in one or more selection areas of the display device a plurality of representations each associated with a primary wagering game or a supplemental game feature;

display a wagering game configuration as a configuration window in a configuration area on the display device;

receive, via the operator control interface, a first input indicating a selection of a first selected representation of the representations from the one or more selection areas;

responsive to receiving the selection of the selected first representation, add the first selected representation to the configuration window;

receive, via the operator control interface, a second input indicating a selection of a second selected representation of the representations from the one or more selection areas; and responsive to receiving the selection of the second selected representation, add the second selected representation to the configuration window.

20. The system of claim 19, wherein the plurality of representations includes a plurality of primary wagering games available for selection and a plurality of supplemental game features associated with each of the primary wagering games, wherein the one or more selection areas includes a first selection area and a second selection area, the primary wagering games being displayed in the first selection area and the supplemental game features associated with each of the primary wagering games being displayed in the second selection area.

21. The system of claim 19, wherein the one or more controllers are further configured to, responsive to receiving a third input to modify a number or index associated with the first or second selected representation, adjust a size of the first or second selected representation within the configuration window.

22. The system of claim 21, wherein the number or index is a payback percentage associated with the first or second selected representation.

23. The system of claim 22, wherein the first selected representation corresponds to a primary wagering game and the second selected representation corresponds to a supplemental game feature associated with the primary wagering game, wherein the payback percentage associated with the primary wagering game corresponding to the first selected representation is a primary payback percentage, and wherein the payback percentage associated with the supplemental game feature corresponding to the second selected representation is a feature payback percentage.

24. The system of claim 19, wherein the one or more controllers are further configured to:

cause the display device to display in the configuration window an overall payback percentage in response to adding the first selected representation to the configuration window; and dynamically update the overall payback percentage in response to the second selected representation being added to the configuration window.

25. The system of claim 24, wherein the one or more controllers are further configured to receive a third input to modify a payback percentage associated with the first or second selected representation and, responsive thereto, dynamically update the overall payback percentage based on the modified payback percentage.

26. The system of claim 19, wherein the second selected representation is visually stacked on top of the first selected representation in the configuration window.

27. The system of claim 19, wherein the first selected representation corresponds to a primary wagering game and wherein the second selected representation corresponds to a supplemental game feature associated with the primary wagering game, and wherein the first selected representation includes a first window within the configuration window and wherein the second selected representation includes a second window within the configuration window, wherein a size of the first window is commensurate with a number or index associated with the primary wagering game corresponding to the first selected representation and wherein a size of the second window is commensurate with a number or index associated with the supplemental game feature corresponding to the second selected representation.

28. A method of configuring a wagering game via an operator control interface, comprising:

displaying, in one or more selection areas of a control screen, a plurality of configuration elements each corresponding to a primary wagering game or a supplemental game feature;

displaying a wagering game configuration in a configuration window of the control screen;

receiving, via the operator control interface, a first input for dragging and dropping a first selected configuration element from the one or more selection areas to the configuration window and displaying the first selected configuration element as a first graphical window in the configuration window;

receiving, via the operator control interface, a second input for dragging and dropping a second selected configuration element from the one or more selection areas to the configuration window and displaying the second selected configuration element as a second graphical window in the configuration window;

receiving, via the operator control interface, a first adjustment input of a number or index associated with the first or second selected configuration elements; and responsive to receiving the first adjustment input, changing a size of the first graphical window or the second graphical window within the configuration window.

29. The method of claim 28, wherein the changing the size results in the size being increased when the first adjustment input increases the number or index associated with the first or second selected configuration elements, and wherein the changing the size results in the size being decreased when the first adjustment input decreases the number or index associated with the first or second selected configuration elements.

30. The method of claim 29, wherein the number or index corresponds to a payback percentage.

31. The method of claim 30, wherein the first selected configuration element corresponds to a primary wagering game and the payback percentage corresponds to a primary payback percentage, and wherein the second selected configuration element corresponds to a supplemental game feature associated with the primary wagering game corresponding to the first selected configuration element and the payback percentage corresponds to a feature payback percentage.

32. The method of claim 29, further comprising:

displaying in the configuration window an overall payback percentage in response to dragging and dropping the first selected configuration element to the configuration window; and dynamically updating the overall payback percentage in response to dragging and dropping the second selected configuration element to the configuration window.

33. The method of claim 28, wherein the second selected configuration element is visually stacked on top of the first selected configuration element in the configuration window.

34. The method of claim 33, further comprising dynamically adjusting an overall height of the stacked configuration elements in the configuration window in real time in response to the receiving the first adjustment input.

35. The method of claim 28, further comprising:

displaying a second wagering game configuration in a second configuration window of the control screen adjacent the configuration window including the first and second configuration elements, the second wagering game configuration including a set of configuration elements selected from the plurality of configuration elements;

displaying each configuration element in the set of configuration elements as corresponding graphical windows stacked on top of one another in the second configuration window;

receiving, via the operator control interface, a second adjustment input of a number or index associated with a configuration element in the set of configuration elements; and responsive to receiving the second adjustment input, changing, within the configuration window, a size of the graphical window corresponding to the configuration element in the set of configuration elements.

36. The method of claim 35, wherein an overall height of the configuration elements in the configuration window indicates an overall payback percentage associated with the wagering game configuration and an overall height of the configuration elements in the second configuration window indicates an overall payback percentage associated with the second wagering game configuration such that a higher relative overall height corresponds to a higher overall payback percentage.

37. One or more physical machine-readable storage media including instructions which, when executed by one or more processors, cause the one or more processors to perform operations for configuring a wagering game via an operator control interface, the operations comprising:

displaying, in one or more selection areas of a control screen, a plurality of configuration elements each corresponding to a primary wagering game or a supplemental game feature;

displaying a wagering game configuration in a configuration window of the control screen;

receiving, via the operator control interface, a first input for dragging and dropping a first selected configuration element from the one or more selection areas to the configuration window and displaying the first selected configuration element as a first graphical window in the configuration window;

receiving, via the operator control interface, a second input for dragging and dropping a second selected configuration element from the one or more selection areas to the configuration window and displaying the second selected configuration element as a second graphical window in the configuration window;

receiving, via the operator control interface, a first adjustment input of a number or index associated with the first or second selected configuration elements; and responsive to receiving the first adjustment input, changing a size of the first graphical window or the second graphical window within the configuration window.

38. The physical machine-readable storage media of claim 37, wherein the changing the size results in the size being increased when the first adjustment input increases the number or index associated with the first or second selected configuration elements, and wherein the changing the size results in the size being decreased when the first adjustment input decreases the number or index associated with the first or second selected configuration elements.

39. The physical machine-readable storage media of claim 38, wherein the number or index corresponds to a payback percentage.

40. The physical machine-readable storage media of claim 39, wherein the first selected configuration element corresponds to a primary wagering game and the payback percentage corresponds to a primary payback percentage, and wherein the second selected configuration element corresponds to a supplemental game feature associated with the primary wagering game corresponding to the first selected configuration element and the payback percentage corresponds to a feature payback percentage.

41. The physical machine-readable storage media of claim 39, the operations further comprising:

displaying in the configuration window an overall payback percentage in response to dragging and dropping the first selected configuration element to the configuration window; and dynamically updating the overall payback percentage in response to dragging and dropping the second selected configuration element to the configuration window.

42. The physical machine-readable storage media of claim 37, wherein the second selected configuration element is visually stacked on top of the first selected configuration element in the configuration window.

43. The physical machine-readable storage media of claim 42, the operations further comprising dynamically adjusting an overall height of the stacked configuration elements in the configuration window in real time in response to the receiving the first adjustment input.

44. The physical machine-readable storage media of claim 37, the operations further comprising:

displaying a second wagering game configuration in a second configuration window of the control screen adjacent the configuration window including the first and second configuration elements, the second wagering game configuration including a set of configuration elements selected from the plurality of configuration elements;

displaying each configuration element in the set of configuration elements as corresponding graphical windows stacked on top of one another in the second configuration window;

receiving, via the operator control interface, a second adjustment input of a number or index associated with a configuration element in the set of configuration elements; and responsive to receiving the second adjustment input, changing, within the configuration window, a size of the graphical window corresponding to the configuration element in the set of configuration elements.

45. The physical machine-readable storage media of claim 44, wherein an overall height of the configuration elements in the configuration window indicates an overall payback percentage associated with the wagering game configuration and an overall height of the configuration elements in the second configuration window indicates an overall payback percentage associated with the second wagering game configuration such that a higher relative overall height corresponds to a higher overall payback percentage.

* * * * *